US011328584B2

(12) United States Patent
Dinkins et al.

(10) Patent No.: US 11,328,584 B2
(45) Date of Patent: May 10, 2022

(54) INDUCTIVELY COUPLED SENSOR AND SYSTEM FOR USE THEREOF

(71) Applicant: Halliburton Energy Services, Inc., Houston, TX (US)

(72) Inventors: Walter Dinkins, Tulsa, OK (US); Tom Gottschalk, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 614 days.

(21) Appl. No.: 16/330,678

(22) PCT Filed: May 29, 2018

(86) PCT No.: PCT/US2018/034938
§ 371 (c)(1),
(2) Date: Mar. 5, 2019

(87) PCT Pub. No.: WO2019/231437
PCT Pub. Date: Dec. 5, 2019

(65) Prior Publication Data

US 2021/0358295 A1 Nov. 18, 2021

(51) Int. Cl.

| | |
|---|---|
| ***G08C 17/04*** | (2006.01) |
| ***E21B 47/008*** | (2012.01) |
| ***E21B 47/13*** | (2012.01) |
| ***E21B 47/01*** | (2012.01) |

(52) U.S. Cl.
CPC ..... *G08C 17/04* (2013.01); *E21B 47/008* (2020.05); *E21B 47/01* (2013.01); *E21B 47/13* (2020.05)

(58) Field of Classification Search
CPC ..... G08C 17/04; E21B 47/008; E21B 47/13; E21B 47/01
USPC ..... 166/250.01
See application file for complete search history.

(56) References Cited

U.S. PATENT DOCUMENTS

| | | | | |
|---|---|---|---|---|
| 5,521,592 | A | 5/1996 | Veneruso | |
| 5,892,430 | A | 4/1999 | Wiesman et al. | |
| 6,061,000 | A * | 5/2000 | Edwards | E21B 47/13 340/854.6 |
| 6,167,965 | B1 | 1/2001 | Bearden et al. | |

(Continued)

FOREIGN PATENT DOCUMENTS

EP 1331648 A2 7/2003

OTHER PUBLICATIONS

International Search Report and Written Opinion dated Feb. 27, 2019; International PCT Application No. PCT/US2018/034938.

*Primary Examiner* — Kerri L McNally
(74) *Attorney, Agent, or Firm* — McGuireWoods LLP

(57) ABSTRACT

Included are inductively coupled sensors for downhole electric submersible pumps and methods of use. An example inductively coupled sensor comprises an electric submersible pump sensor, at least one receiving coil coupled to the electric submersible pump sensor; wherein the receiving coil is inductively coupled to a three-phase power cable of an electric submersible pump. An example method comprises placing an inductively coupled sensor in a wellbore, conducting current in the three-phase power cable; wherein current in the three-phase power cable induces a voltage in the receiving coil sufficient to power the electric submersible pump sensor, and sensing the operating parameter of the electric submersible pump with the electric submersible pump sensor.

20 Claims, 3 Drawing Sheets

(56) References Cited

U.S. PATENT DOCUMENTS

| | | | | |
|---|---|---|---|---|
| 6,452,482 | B1 | 9/2002 | Cern | |
| 8,051,912 | B2 | 11/2011 | Layton | |
| 2002/0121987 | A1 | 9/2002 | Besser et al. | |
| 2005/0275495 | A1 | 12/2005 | Pridmore et al. | |
| 2008/0093922 | A1* | 4/2008 | Layton | E21B 17/028 307/3 |
| 2009/0066535 | A1* | 3/2009 | Patel | E21B 47/00 340/853.2 |
| 2011/0018704 | A1 | 1/2011 | Burrows | |
| 2012/0121224 | A1 | 5/2012 | Dalrymple et al. | |
| 2014/0021909 | A1* | 1/2014 | Klawon | H02J 7/025 320/108 |
| 2016/0130923 | A1* | 5/2016 | Nowitzki | E21B 43/128 166/66.4 |
| 2017/0105251 | A1* | 4/2017 | Viroli | H05B 6/1209 |

* cited by examiner

INDUCTIVELY COUPLED SENSOR AND SYSTEM FOR USE THEREOF

TECHNICAL FIELD

The present disclosure relates to an inductively coupled sensor for electric submersible pumps, and more particularly, to an inductively coupled sensor and associated system for providing electric submersible pump measurements.

BACKGROUND

Electric submersible pumps (hereinafter "ESP" or "ESPs") may be used to pump fluids in a wellbore. ESPs may be powered by a three-phase power cable that is run downhole along the outer diameter of the tubing. The three-phase power cable transmits power downhole to the motor of the ESP. The three-phase power cable connects to the motor of the ESP at the motor's electrical connection where it may be directly spliced without a ground. The three-phase power cable is instead offset. An ESP sensor may make use of this by being wired directly to the three-phase power cable at the motor's electrical connection. The ESP sensor may then be powered by the three-phase power cable and used to transmit data via the three-phase power cable back to the surface.

The ESP's utility is directly related to the continual monitoring of its operating parameters and the wellbore conditions. This monitoring is important for the evaluation of the application design of the ESP and may provide guidance on possible operational changes to optimize the current system. Moreover, this monitoring may provide insight into potential ESP design changes that may be made to optimize the application.

The harsh environment in which the ESP sensors are used may result in premature failure of the ESP sensors. For example, occasionally contaminant water can settle in the Y-point of the induction motor of the ESP where the motor's electrical connection may be disposed. If this happens, the water may contact the direct-wired connection of the ESP sensor to the three-phase power cable inducing a short in the ESP sensor. This event may result in a complete loss of instrumentation. Should this happen, no data from the ESP sensor would be obtainable and the operator would be unable to assess the ESP or regulate it appropriately.

Should the ESP sensor stop working or otherwise be damaged, remediation operations may need to be conducted to regain instrumentation for the ESP. These remediation operations can result in loss or productive time and increased operational expenditures.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to an inductively coupled sensor for electric submersible pumps, and more particularly, to an inductively coupled sensor and associated system for providing electric submersible pump measurements.

Examples of the apparatuses, methods, and systems described herein comprise an inductively coupled sensor used with ESPs. One of the many potential advantages of the disclosed inductively coupled sensor is that the sensor is not wired directly to the three-phase power cable used to power the ESP motor. This may result in prolonging the life of the sensor by mitigating the possibility of a short in the sensor from contact with wellbore fluids such as contaminant water at the point of connection. Another potential advantage of the disclosed sensor is that its receiving coil does not run along or otherwise contact the motor, as may be done in traditional sensor systems for ESPs. This provides further mitigation of potential damage to the sensor or corresponding damage to motor if sensor fails. Yet an additional advantage of the disclosed sensor is that it may be used to measure both suction and discharge pressure of the ESP allowing an operator to evaluate the application design of the ESP and obtain data for potential operational changes to optimize the current system or the ESP design for a desired application.

Figure 1:
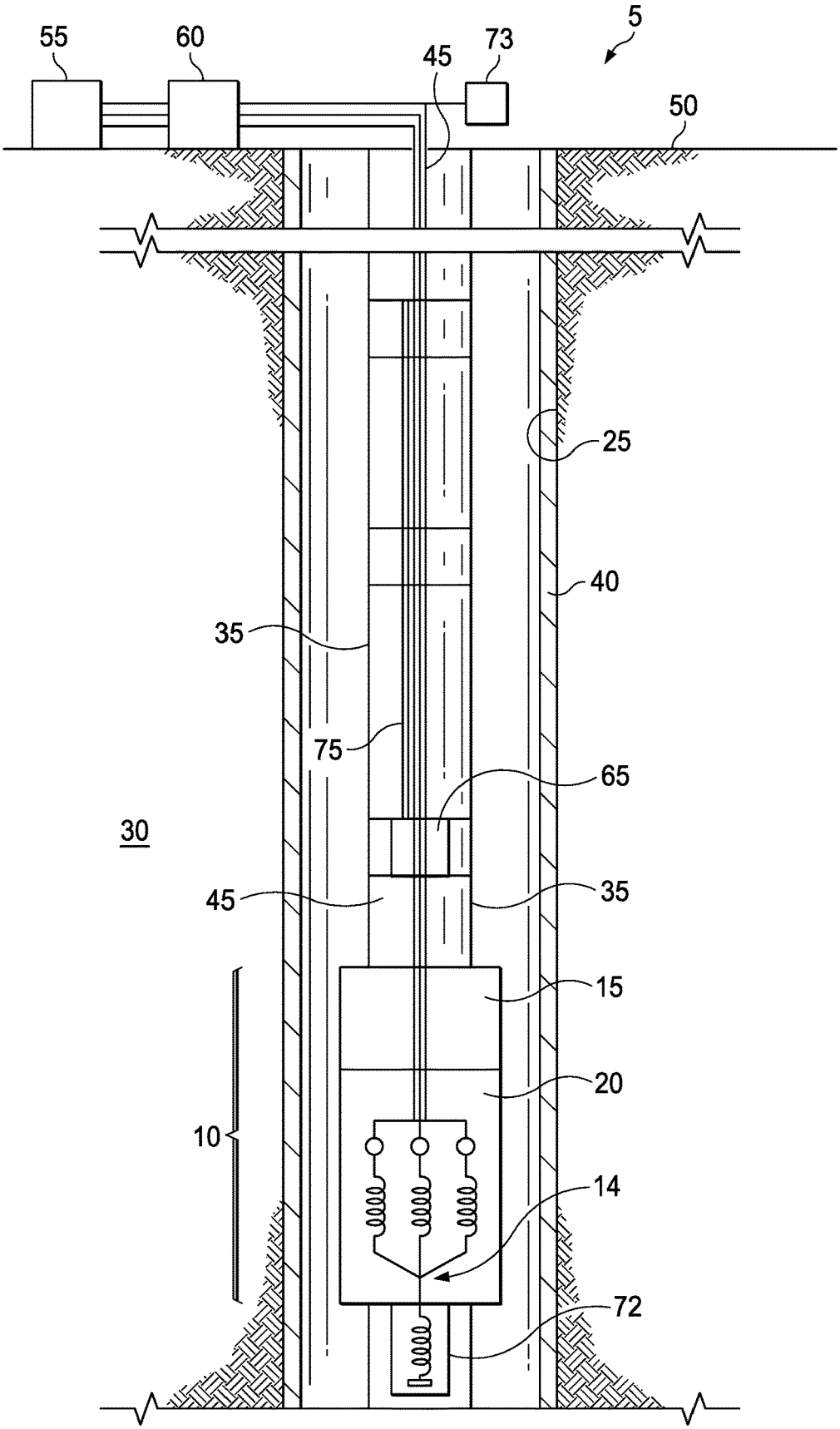
FIG. 1 is a schematic illustrating a production system including an ESP and inductively coupled sensor in accordance with one or more examples described herein.

FIG. 1 is a schematic illustrating a production system, generally 5, including an electrical submersible pump, generally 10, having a pump 15 and motor 20, disposed within a wellbore 25 penetrating a subterranean formation 30. ESP 10 is coupled to tubing 35 disposed within the wellbore 25 and is proximate to the casing 40. A three-phase power cable 45 carries three-phase power into the wellbore 25 and to the motor 20 from the surface 50. At surface 50, a three-phase power source 55, such as a generator or a connection to a local power grid, is coupled to three-phase power cable 45 by a converter/inverter system 60. Converter/inverter system 60 is constructed and operates in a manner known in the art to operate and/or regulate the operating speed of the ESP 10.

Those skilled in the art will recognize that in the interest of clarity the complete structure and operation of production system 5 may not be depicted in the drawings or described herein. For example, the three-phase power cable 45 may be protected through a covering disposed over the three-phase power cable 45, such as a channeled cable protector. Such a protective covering would extend over at least a portion of the three-phase power cable 45 in the wellbore 25 and may reduce contact of the three-phase power cable 45 with the wellbore environment.

At least a portion of three-phase power cable 45 is flat configuration. The flat portion of the three-phase power cable 45 comprises the conductors in a plane positioned in a substantially parallel orientation relative to the exterior area of the tubing 35 adjacent to the three-phase power cable 45. The individual conductors for each phase within the three-phase power cable 45 may be in relatively close proximity to each other. In some optional examples, a portion of the three-phase power cable 45 may be round and may be connected to the flat portion. It is to be understood that the round portion is optional, and that some examples comprise only a flat three-phase power cable 45 with no round portion along the entirety of its length.

An inductively coupled sensor 65 may be positioned on any portion of the tubing 35 at a desired interval, for example, near the top of the motor/pump assembly of the ESP 10. In this particular example, the inductively coupled sensor 65 is disposed in a tubing joint of a section of tubing 35. The inductive loop powering the inductively coupled sensor 65 comprises at least one receiving coil 75 (two are illustrated in this specific example). The receiving coils 75 of the induction loop may be coiled and reeled out after the ESP 10 assembly. The receiving coils 75 may be coupled to any length of the tubing 35, including tubing joints, as is needed to provide an induction loop sufficient for powering the inductively coupled sensor 65. As described in FIG. 2 below, the receiving coils 75 are in close proximity to the conductors of a flat portion of the three-phase power cable 45. The receiving coils 75 are not directly wired to the three-phase power cable 45.

General examples of inductively coupled sensors 65 may include, but are not limited to, pressure sensors, temperature sensors, vibration sensors, flow sensors, acoustic sensors, or any combination thereof.

A surface control system 73 may be coupled to one or more conductors of the three-phase power cable 45, for receiving or transmitting signals to the inductively coupled sensor 65. The inductively coupled sensor 65 may measure a variety of ESP 10 and/or wellbore 25 parameters including, but not limited to, pump 15 suction pressure, pump 15 discharge pressure, motor 20 temperature, downhole wellbore 25 temperature, ESP 10 vibration, the like, or any combination thereof. The inductively coupled sensor 65 may be configured to communicate bi-directionally with the surface control system 73, and may transmit or receive signals over the three-phase power cable 45 concurrently with the three-phase power transmitted to the motor 20. Based on the measurements returned by the inductively coupled sensor 65 to the surface control system 73, the surface control system 73 may be used to control the operation of the ESP 10 and may also provide data sufficient to optimize performance of the ESP 10 for a given application. In some examples, filters may be required within inductively coupled sensor 65 and surface control system 73 to filter the three-phase power transmitted over three-phase power cable 45 concurrently with data measurement or control signals as would be readily apparent to one of ordinary skill in the art having the benefit of this disclosure.

As discussed above, the inductively coupled sensor 65 is not direct wired to the three-phase power cable 45. The inductively coupled sensor 65 is powered by its inductive coupling to the three-phase power cable 45 via the inductive wireless connection. As the inductive coupling is a wireless connection without direct wiring to the three-phase power cable 45, the longevity of the inductively coupled sensor 65 may be improved, as there is no spliced connection vulnerable to environmental attack, for example, contact with contaminant water settled in the motor's Y-point, generally, 14. The inductively coupled sensor 65 is therefore not susceptible to the same degradation or damage due to environmental exposure that direct-wired sensors would be.

In some optional examples, the inductively coupled sensor 65 may further comprise a battery. As the inductively coupled sensor 65 is powered by inductive coupling to the conductors of the three-phase power cable 45, the inductively coupled sensor 65 may only be powered when sufficient electric current is conducted along the three-phase power cable 45. As such, a battery may be used to power inductively coupled sensor 65 when the ESP 10 is turned off and/or when no electric current is conducted through three-phase power cable 45. The battery may be any sufficient battery for temporarily powering the inductively coupled sensor 65 as would occur to one of ordinary skill in the art.

In some optional examples, the production system 5 may further comprise an additional sensor 72 that is non-inductively coupled. This additional sensor may provide the same or different measurements as the inductively coupled sensor 65. In some to these optional embodiments, the non-inductively coupled additional sensor 72 may serve as a back-up to the inductively coupled sensor 65.

The receiving coils 75 used to form the induction loop may be extended along any desired length or segments of tubing 35 and/or tubing joints as needed to provide sufficient power to the ESP 10. Although the receiving coils 75 are illustrated as extending along two sections of tubing 35, it is to be understood that the receiving coils 75 may extend along less or more sections of tubing 35. Likewise, the inductively coupled sensor 65 may be disposed along any portion of tubing 35 and/or tubing joint, including in assemblies in tubing joints as illustrated. Receiving coils 75 may be flattened or snaked as they extend along tubing 35.

Although only one inductively coupled sensor 65 is illustrated, it is to be understood that more than one inductively coupled sensor 65 may be used in some examples. The additional inductively coupled sensors 65 may be coupled to the same or a different set of receiving coils 75 as desired.

It should be clearly understood that the production system 5 of FIG. 1 is merely one example of an application of the principles of this disclosure in practice, and a wide variety of other examples are possible. Therefore, the scope of this disclosure is not limited at all to the details of FIG. 1 described herein and/or depicted in any of the other FIGURES.

Figure 2A:
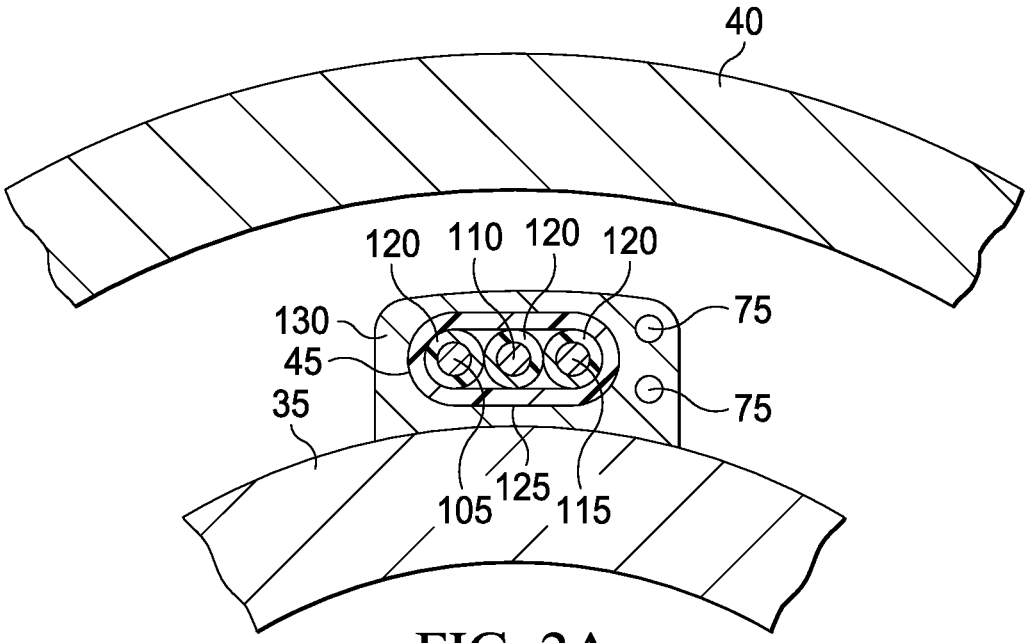
FIG. 2A is a cross-section illustrating one configuration of the inductive coupling of the receiving coils and the three-phase power cable in accordance with one or more examples described herein.
Figure 2B:
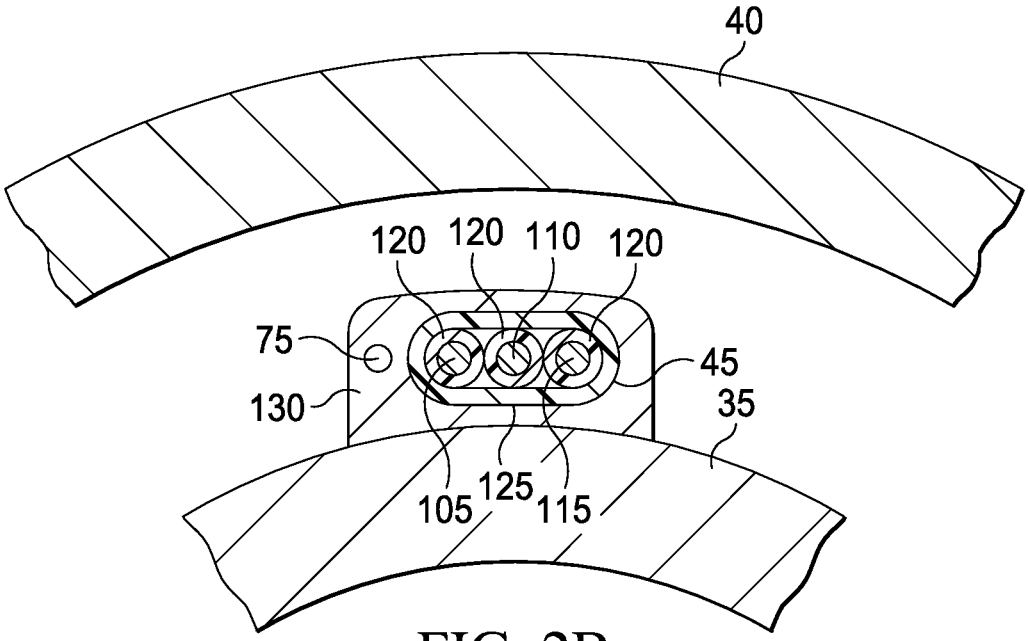
FIG. 2B is a cross-section illustrating another configuration of the inductive coupling of the receiving coils and the three-phase power cable in accordance with one or more examples described herein.
Figure 2C:
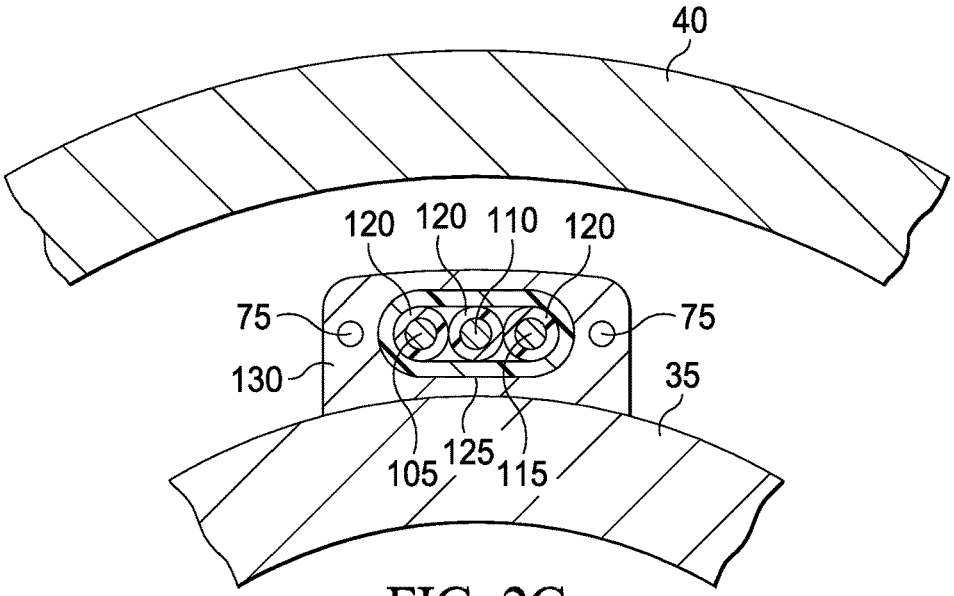
FIG. 2C is a cross-section illustrating an additional configuration of the inductive coupling of the receiving coils and the three-phase power cable in accordance with one or more examples described herein.

FIGS. 2A through 2C are cross-sections of configurations for the inductive coupling of the receiving coils 75 and the three-phase power cable 45. The magnetic field produced by current conducted through the conductors of the three-phase power cable 45 induces a voltage in the receiving coils 75. This induced voltage allows the receiving coils 75 to inductively receive power from the three-phase power cable 45, and to also detect or transmit data signals along the three-phase power cable 45 by similar use of a magnetic field producing current(s) within the conductors. Different configurations of the inductive coupling mechanism resulting from altering the positions of the receiving coils 75 relative to the conductors of the three-phase power cable 45 may be used optimize power generation in the inductively coupled sensor 65 for a particular application.

FIG. 2A is a cross-section of a configuration for the inductive coupling of the receiving coils 75 and the three-phase power cable 45. A flat portion of three-phase power cable 45 is used for powering the motor (e.g., motor 20 as illustrated in FIG. 1) of an ESP (e.g., ESP 10 as illustrated in FIG. 1). This cross-section of the flat portion of three-phase power cable 45 illustrates the conductors 105, 110, and 115 oriented in a plane substantially parallel with a section of tubing 35 disposed within the casing 40. The conductors 105, 110, and 115 may transmit electrical current from a three-phase power source (e.g., three-phase power source 55 as illustrated in FIG. 1) on the surface and into the wellbore. Conductors 105 and 115 are disposed on the ends of the three-phase power cable 45, and conductor 110 is disposed in the middle. Each of the conductors may be surrounded by insulation 120. Moreover, the insulated conductors 105, 110, and 115 may be further surrounded by a protective covering 125.

In order to provide power to an inductively coupled sensor (e.g., inductively coupled sensor 65 as illustrated in FIG. 1), receiving coils 75 are deployed along as many sections of tubing 35 as is necessary to create an induction loop sufficient for powering the inductively coupled sensor 65. In the configuration of FIG. 2A, two receiving coils 75 are disposed adjacent to an end conductor such as the illustrated conductor 115 or the conductor 105. In some alternative embodiments, one receiving coil 75 may be used. In further alternative embodiments, more than two receiving coils 75 may be used.

The strength of the magnetic field created by three-phase power cable 45 may show greater magnitude or variance on end conductors 105 or 115 than on middle conductor 110, or on any conductors within a round three-phase power cable. As such, the receiving coils 75 may be arranged to access the magnetic field produced by the current on said end conductor 105 and/or 115 while maintaining a desirable separation from the influence of the current carried on the middle conductor 110. The separation of influence may result in intensifying the total magnetic field variations proximate to the end conductor(s) and thus enhance the amount of power that may be accessible to the inductively coupled sensor.

The electrical current produced by the receiving coils 75 may be rectified, transformed and/or changed in frequency by electronics within the inductively coupled sensor 65 or other instrumentation. The induced voltage produced within the receiving coils 75 may be transferred to the inductively coupled sensor 65 to power its electronics so it may be used to obtain data about the function of an associated ESP 10.

With continued reference to FIG. 2A, the three-phase power cable 45 and the receiving coils 75 may be held in position, as well as protected from environmental exposure, by a channeled cable protector 130. The channeled cable protector 130 comprises a metal or other durable material useful for shielding the three-phase power cable 45 and the receiving coils 75 from exposure to the wellbore environment to reduce the risk of damage or degradation of the three-phase power cable 45 and the receiving coils 75. The channeled cable protector 130 comprises a channel on its interior of sufficient size to contain the three-phase power cable 45 and the receiving coils 75. The channeled cable protector 130 may be coupled to the tubing (e.g., tubing 30 as illustrated in FIG. 1) using any sufficient means as would be readily apparent to one of ordinary skill in the art.

Although two receiving coils 75 are depicted, it is to be understood that less than or more than two receiving coils 75 may be used as needed to provide sufficient power to an inductively coupled sensor 65 as described above.

FIG. 2B is a cross-section of another configuration for the inductive coupling of the receiving coils 75 and the three-phase power cable 45. In the configuration of FIG. 2B, only one receiving coil 75 is illustrated. The receiving coil 75 is illustrated proximate the end conductor 105 instead of the end conductor 115 as was illustrated in FIG. 2A. It is to be understood that the receiving coils 75 may be disposed against one or both end conductors 105 and 115 as desired or preferred.

As discussed above, the receiving coil 75 may extend adjacent to a conductor, such as conductor 105, for as many sections of tubing 35 as is necessary to create an induction loop sufficient for powering the inductively coupled sensor 65 (as illustrated in FIG. 1). The receiving coil(s) 75 may be positioned in any position around the conductors 105, 110, or 115 of the three-phase power cable 45 so long as they minimize overlap between the conductors. Those skilled in the art will recognize that magnetic effects from the other conductors becomes negligible the further the receiving coil 75 is from the other conductors.

FIG. 2C is a cross-section of another configuration for the inductive coupling of the receiving coils 75 and the three-phase power cable 45. In the configuration of FIG. 2C, two receiving coils 75 are illustrated. Each of the individual receiving coils 75 is proximate to one of the end conductors. For example, one individual receiving coil 75 is proximate to end conductor 105, and the other individual receiving coil 75 is proximate to the other end conductor 115. As such, the two individual receiving coils 75 would see an induced voltage from two different magnetic fields of the three-phase power cable 45.

As discussed above, the receiving coils 75 may extend adjacent to the end conductors 105 and 115, for as many sections of tubing 35 as is necessary to create an induction loop sufficient for powering the inductively coupled sensor 65 (as illustrated in FIG. 1). The receiving coils 75 may be positioned in any position around the end conductors 105 and 115 of the three-phase power cable 45 so long as they minimize overlap between the other conductors. Those skilled in the art will recognize that magnetic effects from other conductors become negligible the further the receiving coil 75 is from the other conductors.

It should be clearly understood that the inductive coupling configurations of FIGS. 2A-2C are merely a few examples of an application of the principles of this disclosure in practice, and a wide variety of other examples are possible. Therefore, the scope of this disclosure is not limited at all to the details of FIGS. 2A-2C described herein and/or depicted in any of the other FIGURES.

Data and/or control signals are preferably impressed on all three conductors 105, 110, and 115, as a single transmission medium, by either a surface control system (e.g., surface control system 73 as illustrated in FIG. 1) or an inductively coupled sensor 65 (as illustrated in FIG. 1) as an electrical signal. The electrical signal may be filtered, transformed and/or amplified as necessary within the inductively coupled sensor 65.

Figure 3:
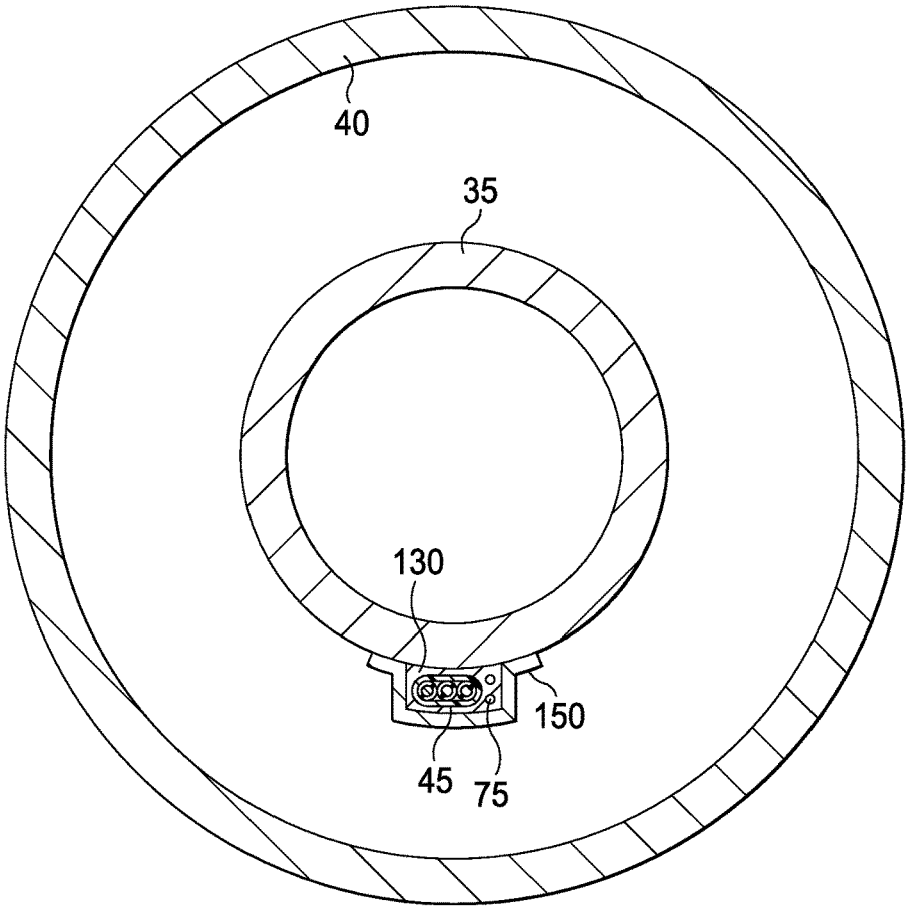
FIG. 3 is a cross-section illustrating the three-phase power cable as coupled to a segment of tubing disposed within a casing cable in accordance with one or more examples described herein.

FIG. 3 is a cross-section illustration of the three-phase power cable 45 coupled to a segment of tubing 35 disposed within a casing 40. On the outer diameter of the tubing 35, a channeled cable protector 130 is disposed. The channeled cable protector 130 is bracketed, clamped, or otherwise coupled to the tubing 35. In the illustration of FIG. 3, bracket 150 is used to couple the channeled cable protector 130 to the tubing 35. As discussed above, the channeled cable protector 130 comprises a channel running through its interior such that the three-phase power cable 45 and the receiving coils 75 may be disposed on the interior of the channeled cable protector 130 where risk of environmental contact may be reduced. As such, all of the wiring or electrically conducting cables for the ESP 10 and the inductively coupled sensor 65 are disposed within the protective covering of the channeled cable protector 130. The use of a channeled cable protector 130 for the receiving coils 75 may prolong the useful life of the inductively coupled sensor (e.g., inductively coupled sensor 65 as illustrated in FIG. 1)

allowing for an ESP (e.g., ESP 10 as illustrated in FIG. 1) to be used with instrumentation longer than traditional arrangements of ESPs and corresponding sensors.

It should be clearly understood that the inductive coupling configurations of FIG. 3 are merely one example of an application of the principles of this disclosure in practice, and a wide variety of other examples are possible. Therefore, the scope of this disclosure is not limited at all to the details of FIG. 3 described herein and/or depicted in any of the other FIGURES.

It is also to be recognized that the disclosed methods and systems may also directly or indirectly affect the various downhole equipment and tools that may contact the inductively coupled sensor or the inductive coupling. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-3.

Provided are inductively coupled sensors for downhole electric submersible pumps in accordance with the disclosure and the illustrated FIGs. An example inductively coupled sensor comprises an electric submersible pump sensor, at least one receiving coil coupled to the electric submersible pump sensor; wherein the receiving coil is inductively coupled to a three-phase power cable of an electric submersible pump.

Additionally or alternatively, the inductively coupled sensor may include one or more of the following features individually or in combination. The receiving coil may be disposed along at least two segments of tubing in a wellbore. The three-phase power cable may comprise three conductors; and the receiving coil may be in closer proximity to one conductor than the other two conductors. The three-phase power cable may comprise three conductors; and the inductively coupled sensor may further comprise at least two receiving coils; wherein the two receiving coils are in closer proximity to the same conductor than the other two conductors. The three-phase power cable may comprise three conductors; and the inductively coupled sensor may further comprise at least two receiving coils; wherein the two receiving coils may be in closer proximity to a different conductor than the other two conductors. The inductively coupled sensor may be configured to measure the electric submersible pump's suction pressure, the electric submersible pump's discharge pressure, the electric submersible pump's motor temperature, a downhole wellbore temperature, the electric submersible pump's vibration, or any combination thereof. The at least one receiving coil may be disposed within an interior channel of a channeled cable protector. The inductively coupled sensor may further comprise a battery.

Provided are methods of sensing an operating parameter of an electric submersible pump in accordance with the disclosure and the illustrated FIGs. An example method comprises placing an inductively coupled sensor in a wellbore, the inductively coupled sensor comprising: an electric submersible pump sensor, and at least one receiving coil coupled to the electric submersible pump sensor; wherein the receiving coil is inductively coupled to a three-phase power cable of the electric submersible pump. The method further comprises conducting current in the three-phase power cable; wherein current in the three-phase power cable induces a voltage in the receiving coil sufficient to power the electric submersible pump sensor; and sensing the operating parameter of the electric submersible pump with the electric submersible pump sensor.

Additionally or alternatively, the method may include one or more of the following features individually or in combination. The receiving coil may be disposed along at least two segments of tubing in a wellbore. The three-phase power cable may comprise three conductors; and the receiving coil may be in closer proximity to one conductor than the other two conductors. The three-phase power cable may comprise three conductors; and the inductively coupled sensor may further comprise at least two receiving coils; wherein the two receiving coils are in closer proximity to the same conductor than the other two conductors. The three-phase power cable may comprise three conductors; and the inductively coupled sensor may further comprise at least two receiving coils; wherein the two receiving coils may be in closer proximity to a different conductor than the other two conductors. The inductively coupled sensor may be configured to measure the electric submersible pump's suction pressure, the electric submersible pump's discharge pressure, the electric submersible pump's motor temperature, a downhole wellbore temperature, the electric submersible pump's vibration, or any combination thereof. The at least one receiving coil may be disposed within an interior channel of a channeled cable protector. The inductively coupled sensor may further comprise a battery.

Provided are systems for sensing an operating parameter of an electric submersible pump in accordance with the disclosure and the illustrated FIGs. An example system comprises an inductively coupled sensor comprising: an electric submersible pump sensor, and at least one receiving coil coupled to the electric submersible pump sensor; wherein the receiving coil is inductively coupled to a three-phase power cable of the electric submersible pump. The system further comprises the three-phase power cable; and the electric submersible pump coupled to the three-phase power cable.

Additionally or alternatively, the system may include one or more of the following features individually or in combination. The receiving coil may be disposed along at least two segments of tubing in a wellbore. The three-phase power cable may comprise three conductors; and the receiving coil may be in closer proximity to one conductor than the other two conductors. The three-phase power cable may comprise three conductors; and the inductively coupled sensor may further comprise at least two receiving coils; wherein the two receiving coils are in closer proximity to the same conductor than the other two conductors. The three-phase power cable may comprise three conductors; and the inductively coupled sensor may further comprise at least two receiving coils; wherein the two receiving coils may be in closer proximity to a different conductor than the other two conductors. The inductively coupled sensor may be configured to measure the electric submersible pump's suction pressure, the electric submersible pump's discharge pressure, the electric submersible pump's motor temperature, a downhole wellbore temperature, the electric submersible pump's vibration, or any combination thereof. The at least one receiving coil may be disposed within an interior channel of a channeled cable protector. The inductively coupled sensor may further comprise a battery.

The preceding description provides various embodiments of the apparatuses, systems, and methods disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps. The compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned, as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified, and all such variations are considered within the scope and spirit of the present invention.

What is claimed is:

1. An inductively coupled sensor comprising:
an electric submersible pump sensor,
at least one receiving coil coupled to the electric submersible pump sensor; wherein the receiving coil is inductively coupled to a three-phase power cable of an electric submersible pump, wherein the at least one receiving coil is disposed within an interior channel of a channeled cable protector.

2. The inductively coupled sensor of claim 1, wherein the receiving coil is disposed along at least two segments of tubing in a wellbore.

3. The inductively coupled sensor of claim 1, wherein the three-phase power cable comprises three conductors; and wherein the receiving coil is in closer proximity to one conductor than the other two conductors.

4. The inductively coupled sensor of claim 1, wherein the three-phase power cable comprises three conductors; wherein the inductively coupled sensor further comprises at least two receiving coils; wherein the two receiving coils are in closer proximity to the same conductor than the other two conductors.

5. The inductively coupled sensor of claim 1, wherein the three-phase power cable comprises three conductors; wherein the inductively coupled sensor further comprises at least two receiving coils; wherein the two receiving coils are in closer proximity to a different conductor than the other two conductors.

6. The inductively coupled sensor of claim 1, wherein the inductively coupled sensor is configured to measure the electric submersible pump's suction pressure, the electric submersible pump's discharge pressure, the electric submersible pump's motor temperature, a downhole wellbore temperature, the electric submersible pump's vibration, or any combination thereof.

7. The inductively coupled sensor of claim 1, further comprising a battery.

8. A method of sensing an operating parameter of an electric submersible pump, the method comprising:
placing an inductively coupled sensor in a wellbore, the inductively coupled sensor comprising:
an electric submersible pump sensor,
at least one receiving coil coupled to the electric submersible pump sensor; wherein the receiving coil is inductively coupled to a three-phase power cable of the electric submersible pump; wherein the at least one receiving coil is disposed within an interior channel of a channeled cable protector;
conducting current in the three-phase power cable; wherein current in the three-phase power cable induces a voltage in the receiving coil sufficient to power the electric submersible pump sensor;
sensing the operating parameter of the electric submersible pump with the electric submersible pump sensor.

9. The method of claim 8, wherein the receiving coil is disposed along at least two segments of tubing in the wellbore.

10. The method of claim 8, wherein the three-phase power cable comprises three conductors; and wherein the receiving coil is in closer proximity to one conductor than the other two conductors.

11. The method of claim 8, wherein the three-phase power cable comprises three conductors; wherein the inductively coupled sensor further comprises at least two receiving coils; wherein the two receiving coils are in closer proximity to the same conductor than the other two conductors.

12. The method of claim 8, wherein the three-phase power cable comprises three conductors; wherein the inductively coupled sensor further comprises at least two receiving coils; wherein the two receiving coils are in closer proximity to a different conductor than the other two conductors.

13. The method of claim 8, wherein the operating parameter is the electric submersible pump's suction pressure, the electric submersible pump's discharge pressure, the electric submersible pump's motor temperature, a downhole wellbore temperature, the electric submersible pump's vibration, or any combination thereof.

14. A system for sensing an operating parameter of an electric submersible pump, the system comprising:
an inductively coupled sensor comprising:
an electric submersible pump sensor,
at least one receiving coil coupled to the electric submersible pump sensor; wherein the receiving coil is inductively coupled to a three-phase power cable of the electric submersible pump; wherein the at least one receiving coil is disposed within an interior channel of a channeled cable protector;
the three-phase power cable; and
the electric submersible pump coupled to the three-phase power cable.

15. The system of claim 14, wherein the three-phase power cable comprises three conductors; and wherein the receiving coil is in closer proximity to one conductor than the other two conductors.

16. The system of claim 14, wherein the three-phase power cable comprises three conductors; wherein the inductively coupled sensor further comprises at least two receiving coils; wherein the two receiving coils are in closer proximity to the same conductor than the other two conductors.

17. The system of claim 14, wherein the three-phase power cable comprises three conductors; wherein the inductively coupled sensor further comprises at least two receiving coils; wherein the two receiving coils are in closer proximity to a different conductor than the other two conductors.

18. The system of claim 14, wherein the inductively coupled sensor is configured to measure the electric submersible pump's suction pressure, the electric submersible pump's discharge pressure, the electric submersible pump's motor temperature, a downhole wellbore temperature, the electric submersible pump's vibration, or any combination thereof.

19. The system of claim 14, wherein the receiving coil is disposed along at least two segments of tubing in a wellbore.

20. The system of claim 14, wherein the inductively coupled sensor further comprises a battery.

* * * * *